United States Patent [19]
O'Connor et al.
[11] 4,241,785
[45] Dec. 30, 1980

[54] HEAT EXCHANGERS AND METHOD OF MAKING SAME

[75] Inventors: Joseph M. O'Connor, Chicago; Stephen F. Pasternak, Park Ridge, both of Ill.

[73] Assignee: Peerless of America, Inc., Chicago, Ill.

[21] Appl. No.: 927,482

[22] Filed: Jul. 24, 1978

[51] Int. Cl.[3] ..... F28F 1/30
[52] U.S. Cl. ..... 165/172; 29/157.3 B; 165/181; 165/150
[58] Field of Search ..... 165/150, 151, 172, 181; 29/157.3 A, 157.3 B; 62/525

[56] References Cited

U.S. PATENT DOCUMENTS

| | | | |
|---|---|---|---|
| 2,092,170 | 9/1937 | Kritzer et al. | 29/157.3 B |
| 2,204,613 | 6/1940 | Nelson et al. | 165/172 X |
| 2,874,555 | 2/1959 | Disinger et al. | 165/150 X |
| 3,468,009 | 9/1969 | Clausing | 29/157.3 B |

*Primary Examiner*—Stephen Marcus
*Attorney, Agent, or Firm*—Emrich, Root, Lee, Brown & Hill

[57] ABSTRACT

A heat exchanger and method of making same, which embodies laterally spaced tubes mounted in a plurality of spaced sets or assemblies of cross-fins, with adjacent ones of the sets of cross-fins being disposed at an angle to each other which is less than 180 degrees, and with the portions of the laterally spaced tubes extending between respective adjacent pairs of the sets of cross-fins being bent around the same radii.

10 Claims, 6 Drawing Figures

HEAT EXCHANGERS AND METHOD OF MAKING SAME

BACKGROUND OF THE INVENTION

This invention relates to heat exchangers and, more particularly, to heat exchangers of the cross-fin type and the method of making the same.

It is a primary object of the present invention to afford a novel cross-fin type of heat exchanger, and a novel method of making the same.

Another object of the present invention is to afford a novel cross-fin type of heat exchanger embodying a plurality of tubes spaced laterally from each other in a transverse direction and mounted in a plurality of spaced sets of assemblies of cross-fins, with the portions of the tubes between adjacent sets of fins being bent in the aforementioned transverse direction to thereby dispose the aforementioned adjacent sets of fins at an angle to each other which is less than 180 degrees.

A further object of the present invention is to afford a novel method of making a cross-fin type of heat exchanger of the last mentioned type.

Heat exchangers, embodying tubes mounted in a plurality of spaced sets of cross-fins, with adjacent sets of cross-fins disposed at an angle to each other which is less than 180 degrees, have been commonly known and used for some time. For example, they have been heretofore used in central home air conditioner units of the so-called "doghouse" type, that are disposed outside of a home; and in heat pump units of the aforementioned "doghouse" type. In such units, the sets of fins have been disposed in different positions relative to each other, such as, for example, two sets of cross-fins being disposed at such an angle to each other as to afford a substantially V-shaped heat exchanger, or three sets of cross-fins disposed at 90-degree angles to each other to afford a substantially U-shaped heat exchanger. Such heat exchangers have also had other applications, such as, for example, being used in refrigeration units, such as, for example, in walk-in coolers and reach-in coolers, and the like.

Heretofore, in many instances, when such types of heat exchangers, embodying laterally spaced tubes mounted in spaced, anglarly-disposed sets of fins, have been used, they have been made by mounting individual tubes in respective sets of assembled cross-fins and then connecting the individual tubes together by mounting and securing thereon separate bent portions of tubing. In other instances, such heat exchangers have been heretofore made with bends between adjacent sets of fin assemblies being made as an integral part of the tubes mounted in those fin assemblies. However, heretofore, heat exchangers of the last mentioned type have commonly been manufactured by first mounting the tubes at the outer side of the heat exchanger in their own spaced assemblies of spaced fins; similarly mounting the tubes at the inner side of the heat exchanger in their own group of spaced assemblies of spaced fins; independently bending each set of tubes around its own radius; and then assembling the two independent sets of tubes and fins together, into nested relation to each other, with the fins in each assembly on one set of tubes being interleafed with fins in a corresponding assembly on the other set of tubes. Such construction has several inherent disadvantages, such as, for example, the fact that the thus nested fins commonly are not properly aligned with each other in the completed heat exchanger; and the spacing between adjacent fins commonly is close, such as, for example, being in the nature of ten fins to an inch, so that it is difficult, at best, to assemble two such sets of fins in a manner wherein the spacing is uniform throughout the assembled set of fins. It is an important object of the present invention to overcome the disadvantages heretofore common in the art with respect to both the construction and the method of making such shaped heat exchangers.

The primary reason why individual sets of tubes and fins were first independently assembled, then bent, and then assembled with respect to each other, when heat exchangers of the aforementioned type, embodying integrally formed bends, were heretofore made in the art, is that the laterally spaced tubes, which were disposed inwardly and outwardly relative to each other in the direction of the bend were bent around two different radii, and it was difficult, if not impossible, as a practical matter, commercially, to assemble the two sets of tubes in the same sets of fins and then bend the two sets of tubes around the different radii.

It is another object of the present invention to afford a novel method of making a heat exchanger embodying laterally spaced sets of tubes disposed in spaced sets of fins, and with the portions of the tubes disposed between adjacent sets of fins bent so as to dispose the adjacent sets of fins at an angle to each other less than 180 degrees, wherein both sets of tubes may first be mounted in the same spaced sets of fins and the portions of the tubes between adjacent sets of fins may then be bent in a novel and expeditious manner so as to dispose the adjacent sets of fins at an angle relative to each other which is less than 180 degrees.

An object ancillary to the foregoing is to afford a novel method of making such a heat exchanger wherein the portions of each of the sets of tubes that are bent so as to dispose the adjacent sets of fins at the aforementioned angles relative to each other are bent around the same radii.

Yet another object of the present invention is to provide a novel cross-fin type of heat exchanger which is practical and efficient in operation, and which may be readily and economically produced commercially.

A further object of the present invention is to afford a novel method of making a cross-fin type of heat exchanger, which method is practical and efficient and may be readily used commercially.

Other and further objects of the present invention will be apparent from the following description and claims and are illustrated in the accompanying drawings, which, by way of illustration, show the preferred embodiment of the present invention and the principles thereof and what we now consider to be the best mode in which we have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
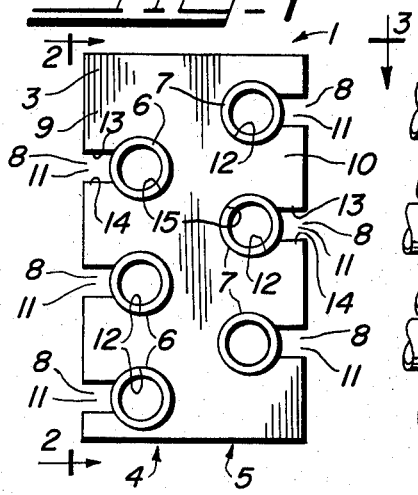
FIG. 1 is an end elevational view of a heat exchanger embodying the principles of the present invention, showing the heat exchanger prior to bending of the same.

A heat exchanger 1, embodying the principles of the present invention, is shown in FIGS. 1–5 of the drawings to illustrate the presently preferred embodiment of the present invention.

The heat exchanger 1 embodies, in general, a plurality of spaced sets or assemblies 2 of spaced cross-fins 3 mounted on two spaced rows 4 and 5 of spaced tubes 6 and 7, respectively.

The cross-fins 3 are of the side-entry type, as illustrated in FIG. 1. Each fin 3 is rectangular in shape and embodies a plurality of identical side-entry slots 8 disposed in spaced relation to each other in the respective longitudinal marginal edge portions 9 and 10 of the fin 3.

Each of the slots 8 has an entry portion 11 which extends inwardly from a respective longitudinal marginal edge 9 or 10 of the respective fin 3, and an enlarged body portion 12 in communication with the inner end of the entry portion 11 and extending inwardly therefrom. The slots 8 are preferably so disposed in each of the fins 3 that the entry portions 11 in each of the longitudinal edge portions 9 and 10 are disposed in parallel relation to each other, with the longitudinal center lines of the entry portions 11 in each edge portion 9 and 10 being disposed midway between the longitudinal center lines of adjacent pairs of the entry portions 11 in the other edge portion 10 or 9.

In the preferred form of the invention shown in the drawings, the shape of the body portions 12 of the slots 8 is that of an arc of a circle, and the entry portions 11, extending outwardly therefrom, are substantially straight, having parallel side walls 13 and 14 extending outwardly from the side walls 15 of the respective body portions 12, FIG. 1.

Preferably, the radius of the arc of the body portion 12 of each of the slots 8 is the same as the normal outside radius of the tubular member affording each of the respective tubes 6 and 7, and the width of each entry portion 11 of the slots 8 is substantially less than the diameter of the body portion 12 to which it is connected, such as, for example, not substantially more than 20% of the diameter of the body portion 12.

In making the novel heat exchanger 1 in accordance with the principles of the preferred method of the present invention, the cross-fins 3 are formed with the entry portions 11 of the slots 8 substantially narrower than the normal outside diameter of the tubes 6 and 7. After the tubes 6 and 7 are formed, they are flattened to such a thickness that they may be inserted transversely, in the direction of the flattening, through the entry portions 11 of the slots 8 into abutting engagement with the portions of the side walls 15 of the respective body portions 12 remote from the entry portions 11 from which the body portions 12 extend.

Figure 2:
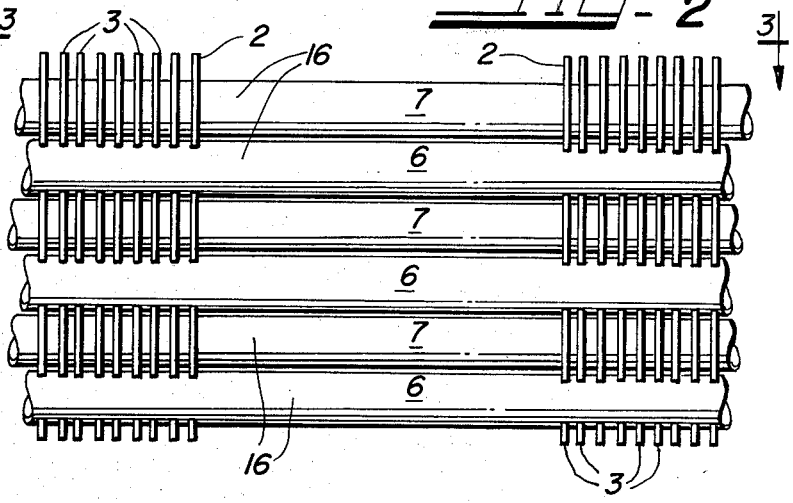
FIG. 2 is a fragmentary, side elevational view of the heat exchanger shown in FIG. 1, looking in the direction of the arrows 2—2 in FIG. 1.
Figure 3:
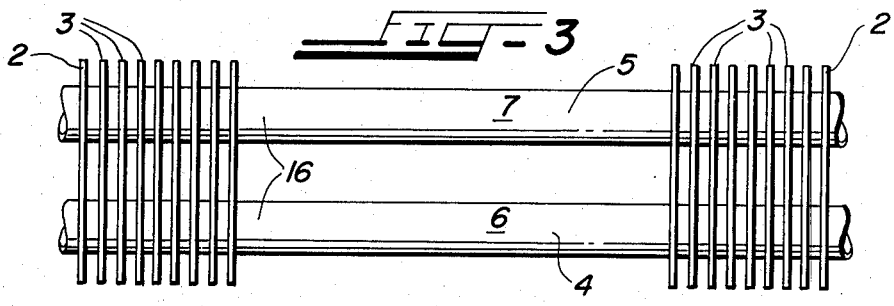
FIG. 3 is a fragmentary, top plan view of the heat exchanger shown in FIG. 1, looking in the direction of the arrows 3—3 in FIG. 2.

With the cross-fins 3 thus constructed, and with the tubes 6 and 7 thus flattened, the fins 3 may be assembled into a plurality of spaced sets or assemblies 2 thereof, such as, for example, the two sets 2 of fins 3 shown in FIGS. 2 and 3. Thereafter, the tubes 6 and 7 may be inserted transversely, in the direction of the flattening thereof, through the entry portions 11 of respective ones of the slots 8 in the marginal edge portions 9 and 10, respectively, in the fins 3, into abutting engagement with the portion of the wall 15 of the body portion 12 of the respective slot 8 remote from the entry portion 11, and the tubes 6 and 7 may then be expanded into the respective body portions 8 into substantially round shape wherein they have again assumed their original outside diameter, or slightly more, so as to firmly engage the side walls 15 of the respective body portions 8 throughout the length of the respective side walls 15. Such expansion of the tubes 6 and 7 preferably is performed by the simultaneous application of external pressure on the tubes 6 and 7 effective to maintain the latter in engagement with the portions of the side walls 15 of the respective body portions 12 in which they are mounted remote from the entry portions 11 from which the body portions 12 extend, and of internal pressure applied by working fluid inside the tubes 6 and 7, in the manner disclosed in greater detail in U.S. Pat. No. 3,546,763, issued to S.F. Pasternak.

Figure 4:
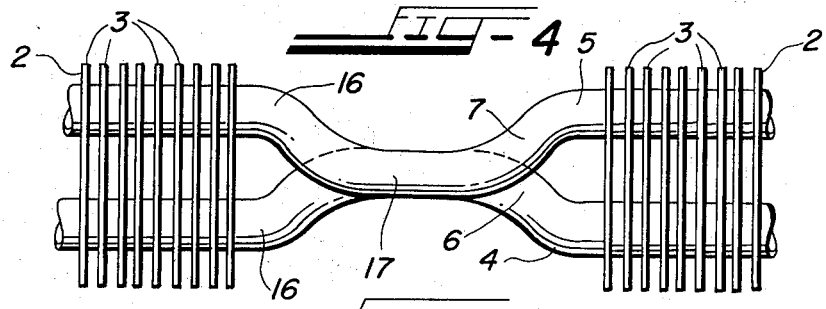
FIG. 4 is a view similar to FIG. 3, but showing the heat exchanger after an additional manufacturing step has been performed thereon.

With the sets 2 of cross-fins 3 thus mounted in spaced relation on the tubes 6 and 7, the portions 16 of each of the tubes 6 and 7 disposed between a respective adjacent pair of the sets 2 of the fins 3, FIGS. 2 and 3, may be bent in a suitable bending die, not shown, laterally inwardly toward the longitudinal central plane of the adjacent sets 2, disposed between and parallel to the marginal edge portions 9 and 10 of the fins 3, into position wherein the intermediate portions 17 of the portions 16 of all of the tubes 6 and 7, disposed between each respective pair of the aforementioned adjacent sets 2 of fins 3, are disposed in uniplanar relation to each other, as illustrated in FIG. 4.

Figure 5:
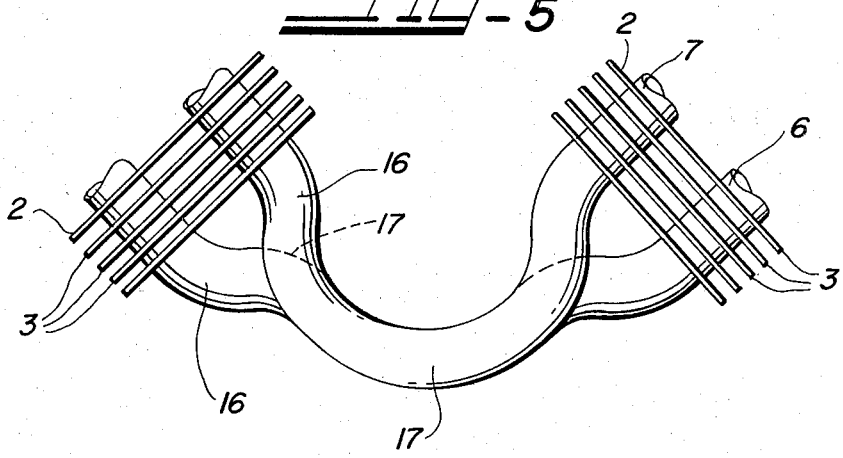
FIG. 5 is a view similar to FIG. 4, but showing the heat exchanger after the final bending step has been performed thereon.

Thereafter, with the intermediate portions 17 of the portions 16 of the tubes 6 and 7, which are disposed between each adjacent pair of sets 2 of fins 3, disposed in the aforementioned uniplanar relation to each other, these intermediate portions 17 may be bent, in a suitable bending die, not shown, around a single radius, in a direction transverse to the plane defining the uniplanar relationship of the intermediate portions 17, to thus move the previously longitudinally aligned pairs of sets 2 of fins 3 into a position wherein the adjacent sets 2 are disposed at an angle to each other, which is less than 180 degrees, as shown in FIG. 5.

Figure 6:
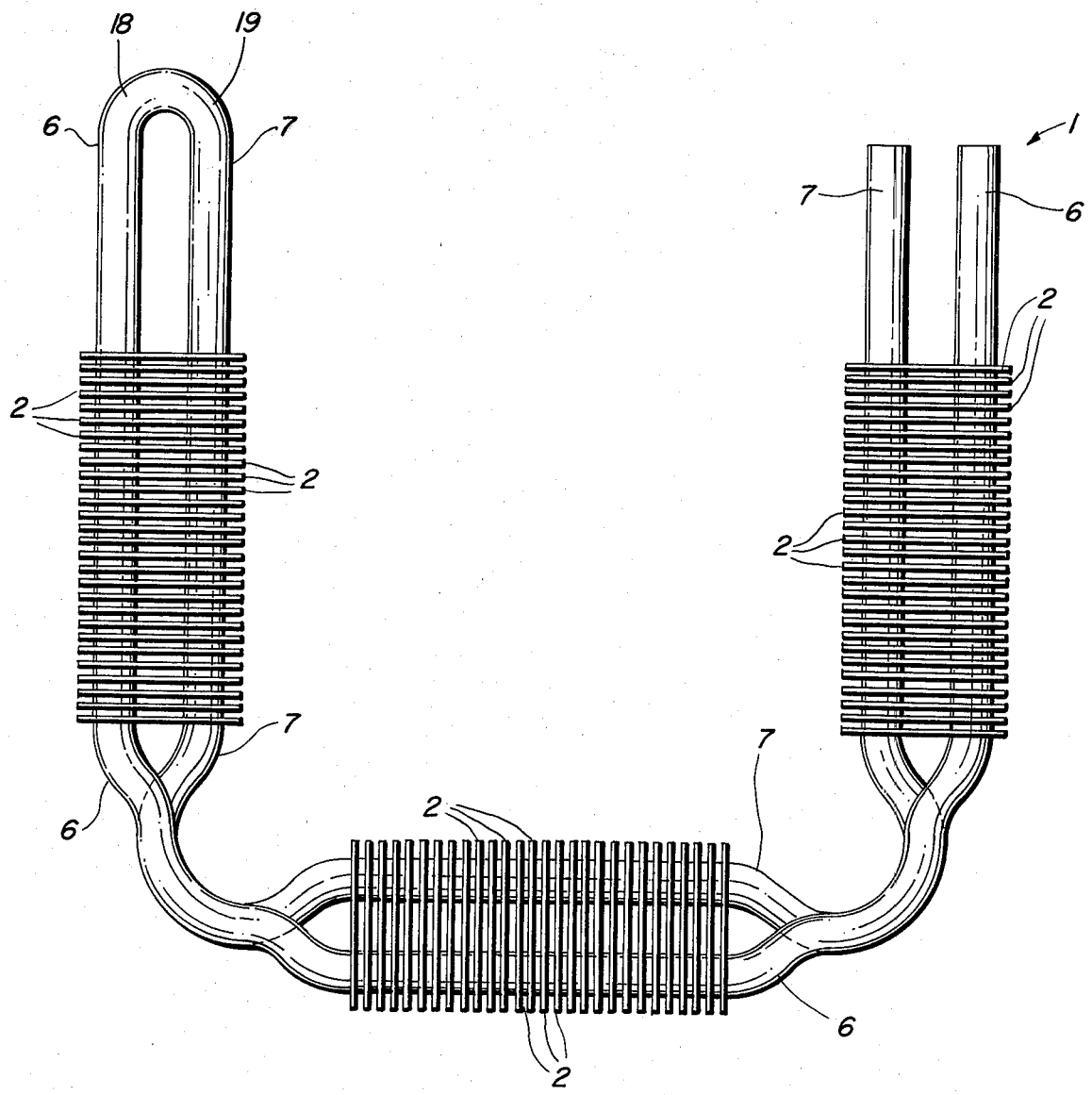
FIG. 6 is a diagrammatic top plan view of a complete U-shaped heat exchanger, embodying the principles of the present invention.

It will be appreciated by those skilled in the art that although two sets 2 of fins 3 are shown in FIGS. 2–5, this is merely by way of illustration and not by way of limitation, and a greater number of sets 2 of fins 3 may be mounted on the tubes 6 and 7 in spaced relation to each other longitudinally of the tubes 6 and 7 without departing from the purview of the broader aspects of the present invention. For example, rather then affording a V-shaped heat exchanger, as shown in FIG. 5, it may be desired to afford a heat exchanger of other shape, such as, for example, the substantially U-shaped diagrammatically illustrated in FIG. 6. In such instances, the same method as previously described, preferably, is used, namely, to first mount and secure substantially straight tubes 6 and 7 in all of the sets 2 of fins 3; thereafter bend the intermediate portions 17 of the portion 16 of the tubes 6 and 7, disposed between adjacent ones of the sets 2 of the fins 3, into the aforementioned uniplanar relation to each other; and thereafter bend the intermediate portions 17 disposed between adjacent ones of the sets 2 of the fins 3 around the same radii to thereby dispose the adjacent sets 2 at the desired angular relation to each other.

Also, as will be appreciated by those skilled in the art, although the heat exchanger 1 has heretofore been described as embodying slots 8 having narrow entry portions 11 and enlarged body portions 12 and the tubes 6 and 7 have been described as being mounted in the slots 8 by first flattening the tubes 6 and 7 and then expanding them into close fitting engagement with the side walls 15 of the body portions 12 of the slots 8, this is merely by way of illustration of the preferred embodiment of the present invention and not by way of limitation as to the broader aspects thereof, and the openings in the fins 6 may be of a different form, the tubes 6 and 7 may be inserted into the openings in a different manner, and the tubes 6 and 7 may be secured to the fins 3 in a different manner, such as, for example, by soldering, without departing from the purview of the broader aspects of the present invention.

In addition, as will be appreciated by those skilled in the art, although the heat exchanger 1 is shown herein as embodying two rows 4 and 5 of tubes 6 and 7, this is merely by way of illustration and not by way of limitation, and a greater number of laterally spaced rows of tubes may be used without departing from the purview of the broader aspects of the present invention.

Also, as will be appreciated by those skilled in the art, although the members 6 and 7 have been referred to herein as "tubes", this is merely by way of easy reference thereto, and although the members 6 and 7 may consist of individual tubes, they may be of other form, without departing from the purview of the broader aspects of the present invention. For example, they may be portions of the same unitary tubular member, such as the member 18, shown in FIG. 6, embodying a return bend, such as the return bend 19, FIG. 6, disposed between the upper tubes 6 and 7 or the lower tubes 6 and 7, as viewed in FIG. 1, of the entire heat exchanger 1, and with adjacent ones of the tubes 6 and adjacent ones of the tubes 7 connected together by suitable return bends, not shown, in the manner disclosed in U.S. Pat. No. 3,780,799, issued to S. F. Pasternak. As will be appreciated by those skilled in the art, in assembling the tubes 6 and 7 on the sets 2 of fins 3 in a heat exchanger of the last mentioned type, the rows 4 and 5 of the tubes 6 and 7, respectively, may be swung inwardly around the return bend 19 into the slots 8 in the respective marginal edge portions 9 and 10 of the fins 3 in a manner similar to that disclosed in greater detail in the aforementioned U.S. Pat. No. 3,780,799.

From the foregoing, it will be seen that the present invention affords a novel heat exchanger wherein adjacent sets of fins are connected together and may be disposed at an angle relative to each other, which is less than 180 degrees, in a novel and expeditious manner.

Also, it will be seen that the present invention affords a novel method of making a heat exchanger.

In addition, it will be seen that the present invention affords a novel cross-fin type of heat exchanger which is practical and efficient in operation, and which may be readily and economically produced commercially.

Also, it will be seen that the present invention affords a novel and practical method of making heat exchangers, which method is efficient and may be readily utilized commercially.

Thus, while we have illustrated and described the preferred embodiment of our invention, it is to be understood that this is capable of variation and modification, and we therefore do not wish to be limited to the precise details set forth, but desire to avail ourselves of such changes and alterations as fall within the purview of the following claims.

We claim:

1. A heat exchanger comprising a. a plurality of sets of one-piece fins, b. tubes (1) mounted in oppositely disposed marginal edge portions of each of said sets of fins and (2) having portions extending between adjacent pairs of said sets of fins, c. part of said portions of said tubes being disposed in substantially uniplanar relation to each other, and d. said tubes being bent at said part of said portions in a direction transverse to the plane defining said uniplanar relationship to thereby dispose said adjacent pairs of sets of fins at an angle relative to each other which is less than 180 degrees.

2. A heat exchanger as defined in claim 1, and in which a. said tubes are mounted in slots, opening outwardly through respective ones of said oppositely disposed marginal edge portions.

3. A heat exchanger as defined in claim 1, and in which a. said plurality of sets of fins comprises two sets of fins, and b. said two sets of fins are so disposed relative to each other as to define substantially a V-shape.

4. A heat exchanger as defined in claim 1, and in which a. said plurality of sets of fins comprises three sets of fins, and b. said three sets of fins are so disposed relative to each other as to define substantially a U-shape.

5. A heat exchanger comprising a. a plurality of sets of a plurality of one-piece cross-fins, b. each of said sets of cross-fins having a row of outwardly opening slots in each of two oppositvely disposed marginal edge portions thereof, c. said slots in each of said sets of cross-fins having corresponding slots in the other of said sets of cross-fins to afford individual sets of slots, d. a plurality of tubes, e. each of said tubes being disposed in a respective one of said sets of slots, f. each of said tubes having a portion extending between adjacent ones of said sets of cross-fins, and g. said portions of said tubes extending between each pair of adjacent ones of said sets of cross-fins having intermediate portions disposed in substantially uniplanar relation to each other, and h. said tubes having bends formed in said intermediate portions in position to dispose said adjacent ones of said sets of cross-fins at an angle relative to each other that is less than 180 degrees.

6. The method of making a heat exchanger comprising a. forming two spaced fin assemblies, each having
(1) an opening formed in each of two oppositely disposed marginal edge portions thereof b. forming two elongated, substantially straight tubes, c. mounting said tubes in said fin assemblies, with
(1) one portion of each of said tubes mounted in a respective one of said openings in a respective one of said marginal edge portions of each of said fin assemblies, and (2) another portion of each of said tubes extending between adjacent ones of said fin assemblies, d. bending an intermediate portion of said other portion of each of said tubes inwardly toward the side of the space between said adjacent fin assemblies remote therefrom into position to dispose said intermediate portions, between said adjacent fin assemblies between which they extend, in uniplanar relation to each other in a direction transverse to the spacing between said one portions of said tubes disposed in opposite ones of said marginal edge portions, and e. bending said tubes around said intermediate portions in a direction transverse to the plane defining said uniplanar relationship to thereby dispose said adjacent fin assemblies at an angle relative to each other which is less than 180 degrees, and f. securing said tubes to said assemblies.

7. The method of making a heat exchanger comprising a. forming a plurality of spaced cross-fin assemblies, each having
(1) a plurality of outwardly opening slots in each of two oppositely disposed marginal edge portions thereof, b. forming a plurality of elongated, substantially straight tubes, c. inserting said tubes in said slots with each of said tubes
(1) being disposed in aligned slots in each of said assemblies, and
(2) having a portion extending between each respective adjacent pair of said assemblies, d. bending said portions of said tube which are disposed between adjacent pairs of said assemblies into position to dispose intermediate portions thereof into substantially uniplanar relation to each other, and e. bending said tubes around said intermediate portions disposed between respective adjacent pairs of said assemblies in a direction transverse to the plane of said uniplanar relationship thereof to thereby dispose said respective pairs of assemblies at an angle relative to each other which is less than 180 degrees.

8. The method of making a heat exchanger as defined in claim 7, and a. in which
(1) each of said slots has
(a) an entry portion opening outwardly through the marginal edge of the respective one of said marginal edge portions in which it is disposed, and
(b) a body portion extending from said entry portion on the side thereof remote from said marginal edge, and having a greater width perpendicular to the longitudinal center line of said entry portion than the narrowest width of said entry portion, and b. which includes
(1) flattening said tubes to a width less than the narrowest width of said entry portions prior to insertion of said tubes into said slots,
(2) inserting said thus flattened tubes transversely through said entry portions into said body portions in the direction of said flattening, and
(3) expanding said tubes in said body portions into abutting engagement with the side walls of said body portions.

9. The method of making a heat exchanger as defined in claim 8, and in which a. said bending of said portions of said tubes is in the direction of said flattening thereof.

10. The method of making a heat exchanger as defined in claim 9, and in which a. said expanding of said tubes is accomplished by the simultaneous application of
(1) external pressure on said tubes effective to maintain said tubes in engagement with the portions of said side walls of said respective body portions in which they are mounted remote from said entry portions from which said body portions extend, and
(2) internal pressure applied by working fluid inside said tubes.

* * * * *